United States Patent [19]

Larouche

[11] Patent Number: 4,635,417

[45] Date of Patent: Jan. 13, 1987

[54] PORTABLE PARTITIONING PANEL

[75] Inventor: Gilles Larouche, Mont St-Hilaire, Canada

[73] Assignee: Societe d'Energie de la Baie James, Montreal, Canada

[21] Appl. No.: 764,181

[22] Filed: Aug. 9, 1985

[51] Int. Cl.[4] ..... E04B 2/72

[52] U.S. Cl. ..... 52/239; 52/145; 52/126.7; 160/135; 160/351

[58] Field of Search ..... 52/36, 238.1, 239, 144, 52/145, 126.7, 404; 160/378, 369, 135, 351

[56] References Cited

U.S. PATENT DOCUMENTS

| | | | |
|---|---|---|---|
| 2,969,565 | 1/1961 | Levy . | |
| 3,121,262 | 2/1964 | Loncoske | 52/145 X |
| 3,289,368 | 12/1966 | Mark . | |
| 3,841,042 | 10/1974 | Siegal . | |
| 3,871,153 | 3/1975 | Birum, Jr. . | |
| 3,949,827 | 4/1976 | Witherspoon . | |
| 4,084,367 | 4/1978 | Saylor et al. | 52/145 X |
| 4,269,005 | 5/1981 | Timmons | 52/239 X |
| 4,296,579 | 10/1981 | Proud | 52/239 |
| 4,391,073 | 7/1983 | Mollenkopf et al. | 52/239 X |
| 4,446,663 | 5/1984 | Stumpf et al. | 52/144 |

FOREIGN PATENT DOCUMENTS

| | | | |
|---|---|---|---|
| 3207415 | 10/1982 | Fed. Rep. of Germany | 52/126.7 |

*Primary Examiner*—William F. Pate, III
*Assistant Examiner*—R. Chilcot
*Attorney, Agent, or Firm*—Robic, Robic & Associates

[57] ABSTRACT

A portable panel of partitioning a building space, which panel is aesthetic, practical in use and not very expensive to manufacture. This panel comprises two wall units both having the same surface area. The units are mounted end to end and externally covered with a single piece of cloth fixed to their internal periphery. The wall units are closed once against the other with the piece of cloth acting as a hinge, such closing advantageously dissimulating the fixation of the piece of cloth onto the wall units and thus avoiding the use of a decorative mask. The panel also comprises at least one passage provided in at least one of the wall units for operatively installing the panel in the building space in a removable manner. In addition, the portable panel may further comprise a sound insulating sheet provided on its both sides with a covering layer of not compressed material for improving the acoustic efficiency of the whole panel. The insulation sheet and its two covering layers are located inside the panel between the two wall units. A method of manufacturing the above-described panel as well as a method of rapidly partitioning a building space with at least one panel of the above-mentioned type are also disclosed and claimed.

3 Claims, 5 Drawing Figures

1
3
41
43
45
47
51
53
55
57
59
61
63
65
67
69
71

PORTABLE PARTITIONING PANEL

The present invention relates to a portable panel for partitioning a building space in a fast manner and to a method for manufacturing such a panel.

The invention also relates to a method for rapidly partitioning a building space by using at least one portable panel according to the invention.

It has been well known for many years to use easily transportable modular panels for partitioning an empty building space in a very fast manner. Partitionning systems of this type are shown, by way of example, in U.S. Pat. Nos. 3,289,368 and 3,841,042 which both disclose modular panels lying on horizontal profile members that are themselves mounted on vertical support legs and in which electrical plugs and telephone connections are incorporated. It has also been known for many years to use acoustic panels whose structure includes a plurality of layers of insulating material covered and maintained by an external decorative piece of cloth, for stopping the sound or noise in a building space. Acoustical panels of this type are disclosed, by way of example, in U.S. Pat. Nos. 3,871,353 and 3,949,827.

Last of all, it has been well known for many years to use support means adjustable in height for facilitating the installation of vertical panels at given height. A support of this type is shown, by way of example, on FIG. 3 of U.S. Pat. No. 2,969,560.

If all the known partitioning systems referred to hereinabove each present some advantages, none of them combines and simultaneously develops to a maximum extent the following features : aesthetic aspect, practical use and low manufacturing cost. In particular, none of the known systems combines the advantages of the easily transportable and installable modular partitioning systems, the advantages of the acoustical panels systems and the advantages of the support means adjustable in height for facilitating the installation of vertical panels. None of the known systems also combines together aesthetic, practical and economical features. Indeed, the systems that are very aesthetic are generally very expensive and not very practical; the practical sustem are often not very aesthetic and the economical system are generally not very aesthetic or not very practical in use.

The present invention proposes a new type of portable panel for rapidly partitioning a building space, which panel has and combines aesthetic, practical and economical features altogether.

More particularly, the present invention proposes a new type of portable panel whose structure advantageously distinguishes over the structures of the already known portable panels by its simple conception that makes it easy to manufacture even by a not-specialized labor, with standard materials available everywhere and, therefore, at an extremely low cost while being simultaneously very aesthetic and practical in use.

The portable panel for partitioning a building space according to the invention comprises, as basic structural elements:

(a) two wall units both having the same surface area, these units being mounted end to end and externally covered with a single piece of cloth fixed to their internal periphery;

(b) means integral to at least one of said wall for operatively installing the panel in the building space to be partitioned, in a removable manner.

As soon as the piece of cloth is fixed, the wall units are closed one against the other with the piece of cloth acting as a hinge. When closed, each wall units forms one of o the walls of the panel. The wall units are then fixed to each other. Their closing advantageously dissimulates the fixation of the piece of cloth onto the wall units and thus avoids using a decorative mask as is done presently to hide the lines of fixation of the cloth.

Because of its very simple structural conception, the portable panel according to this invention is very easy to manufacture from standard materials available everywhere, which of course makes it very interesting on an economical point of view. The most essential feature in this new conception and accordingly in the manufacture of portable panels according to the invention, is that each panel is manufactured with two units having the same surface area that are closed one against the other to form together both walls of the panel. The single piece of cloth used for covering simultaneously both units is fixed to the internal common periphery of these units before closing the same and advantageously gives a nice aspect to the units. Indeed it completely avoids installing a wood edging or any other decorative element for hiding the line of fixation of the cloth onto the units.

This new structural conception is also particularly interesting in that a slot is created along the lateral sides of the panel when the units are closed. This slot can be used for receiving fixation anchors when several panels are to be used and connected together either in line or perpendicular to each other.

This new structural conception in which the covering piece of cloth acts as a hinge for maintaining together the adjacent ends of both units, is also interesting as it substantially simplifies the labor necessary for covering the units or changing the covering when it is nccessary.

According to a preferred embodiment of the invention, each wall unit comprises a board of rigid insulating material fixed onto a frame. In this embodiment, the installation means consist of at least one passage provided in at least one of the frames for receiving a support rod.

According to another preferred embodiment of the invention, the portable panel further comprises a sound insulating sheet such as a sheet of aluminium, whose both sides are covered with sheets of not-compressed material such as fiber glass, in order to improve the acoustic factor of the panel by muffling the sound stopped by the insulating sheet and avoiding it to pass through the panel. The insulation sheet and its two covering layers are located inside the panel between the two wall units and are pinched therebetween when the units are closed one against the other.

Preferably, the units are maintained one against the other in closed position by a thin metal plate extending along all the length of the ends of the units closed one against the other, the closed ends defining the bottom of the panel.

According to a further preferred embodiment of the invention, the frame of each unit comprises at least two uprights made of wood whose ends are connected by two horizontal planks defining the upper and lower ends of each wall units ;, respectively. Each passage defining the installation means is in turn defined by two other uprights made of wood and fixed parallel to the uprights of the frame of at least one of the units betwen two vertical planks whose surfaces are parallel to the surfaces of the wall units. The two other uprights and the two vertical planks together define a passage suitable for receiving vertical support rods.

Advantageously, the frame of each unit may further comprises a pair of external uprights extending on both sides thereof and a plurality of internal uprights spaced apart from each other between the external uprights. The internal uprights of both of units are mounted in alternate rows to pinch the insulation sheet and its two covering layers threbetween and thus to improve the acoustic factor of the panel.

The triple acoustical insulation sheeting which is compressed between the internal uprights of the panel advantageously acts to cushion the external boards of the units against any external pressure.

The portable panel for partioning a building space according to the invention can be manufactured as follows by:

(a) placing a single piece of covering cloth onto a plane surface;

(b) installing onto this piece of cloth two wall units having the same surface while leaving a short space between the unit, this space being substantially equal to the total thickness of both wall units;

(c) fixing the piece of cloth onto the internal periphery of both said wall units;

(d) fixing to at least one of the wall units means for operatively installing the panel, in the building space in a removable manner;

(e) closing both wall units one against the other using the piece of cloth as a hinge and maintaining together both ends of said units; and (f) fixing said wall units together once they are closed.

As soon as they are manufactured, the portable panels according to the invention can be used for rapidly partioning as building space. To do so, the following steps can be followed:

(a) placing onto the building space at least two support rods that may be adjustable in height and, if desired provided with horizontal sleeves for receiving longitudinal plynthes connectable to a source of power and to the telephone network in order to distribute power and to connect telephones along the panels;

(b) mounting on the support rods at least one portable panel according to the invention; and (c) when the number of panels to be mounted is higher than two, connecting the panels together by lateral insertion of fixation anchors between the closed wall units of each panel.

The installation and fixation of the support rods onto the floor of the building space can be made in any suitable manner. As soon as the rods are aligned and rigidly positioned onto the floor, it is very easy to install the portable panel(s) according to the invention simply by introducing the upper ends of the rods into the passages provided for that purpose in the lower ends of the panels and by letting the panel(s) move down.

If two panels are to be installed in line, they can be connected to each other by means of fixation anchor in the shape of a thin rectangular plate that is inserted in the vertical slot created between the units when they are closed one against the other. If the panels are to be fixed perpendicularly to each other, use can be made of fixation anchor in the shape of a thin T-or H-shaped element that is introduced in the vertical slot extending along the lateral edge of the panels and thereafter rotated at 90° to lock them.

The present invention and its various advantages will be better understood with reference to the following description of a preferred enbodiment thereof, taken in connection with the accompanying drawings in which:

FIG. 1 is a perspective view of a system of portable panels according to the invention, used for partitioning a building space;

FIG. 2 in an exploded perspective view of a portable panel according to the invention;

Figures 1, 5:
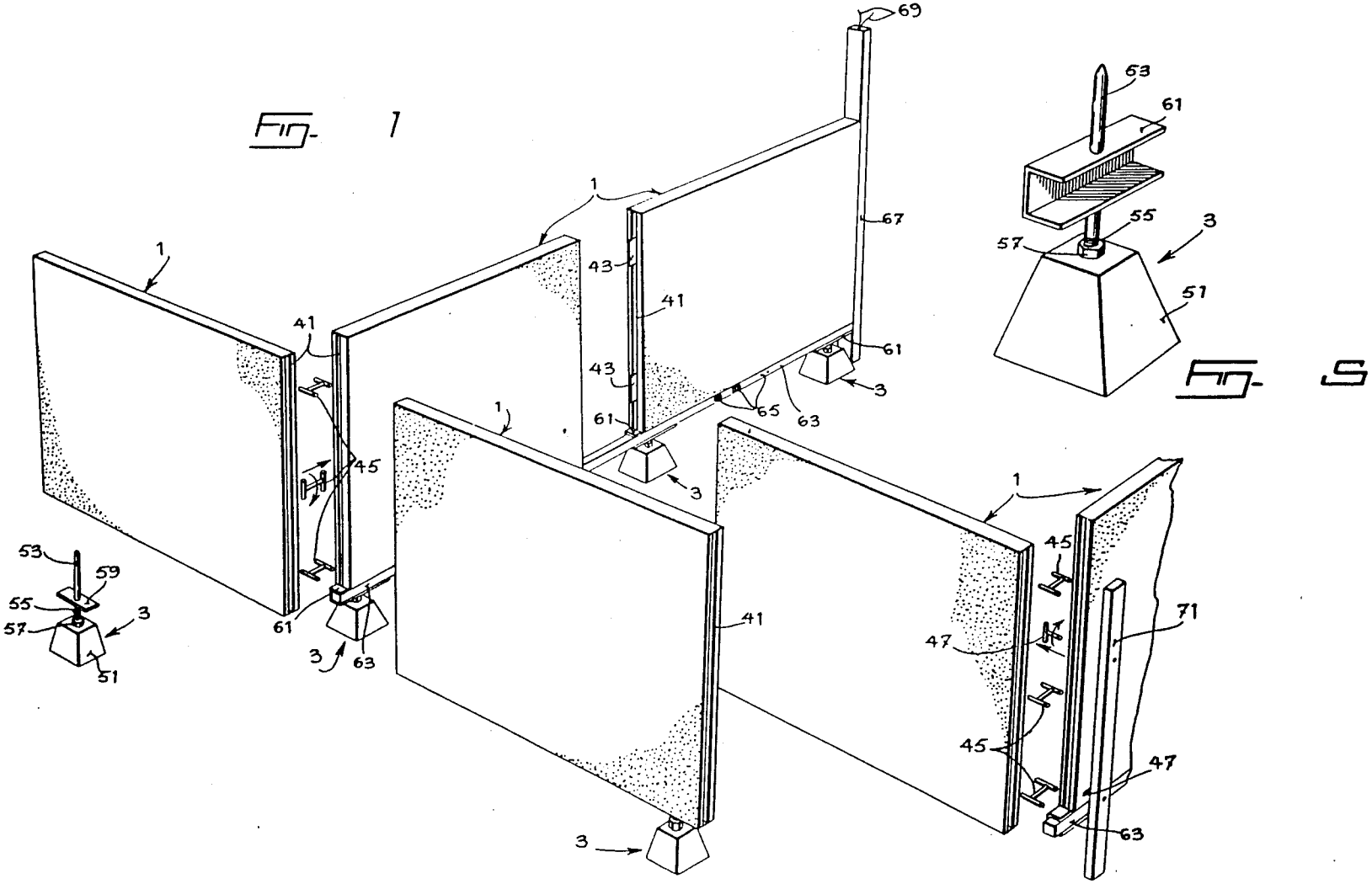
FIG. 5 appearing on the same sheet of drawings as FIG. 1 is a perspective view of an adjustable support rod provided with a sleeve, for the installationof portable panels according to the invention.

The system for rapidly partitioning a building space according to the invention is illustrated in a very general manner on FIG. 1. This system calls for a plurality of the portable panels 1 that are preferably all of the same size although this is not compulsory.

The panels 1 used for partitioning the building space are mounted on supports 3 that are previously placed onto the floor of the building according to the consummer's desired pattern. Of course, any kind of disposition and arrangement generally used for partitioning an empty room in order to obtain a partitioned office including recesses, alcoves and corridors, is possible according to the consummer's requirements. The structure of the support 3 used for installing the panel 1 will be described in detail hereinafter.

Figure 2:
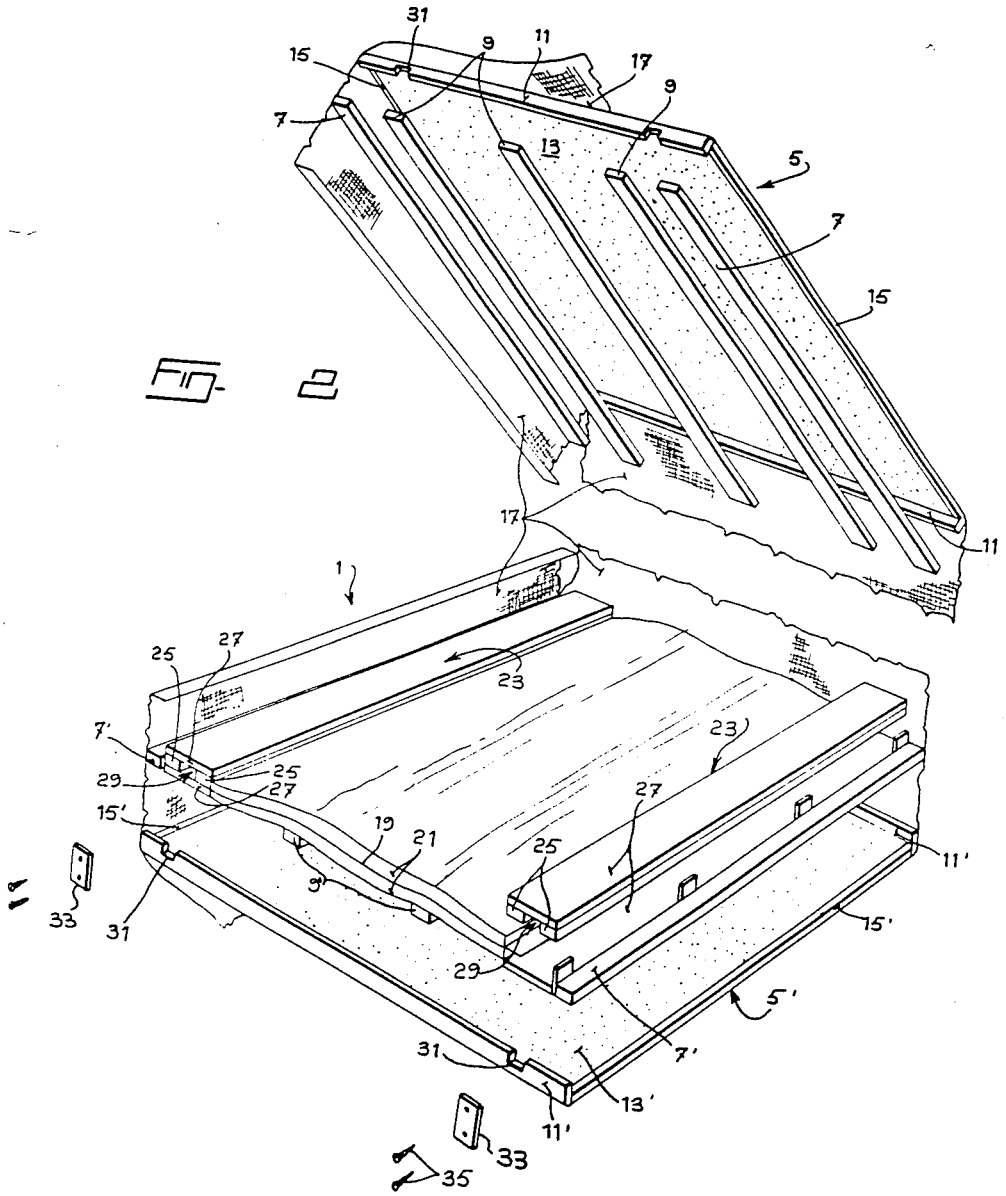
Figure 3:
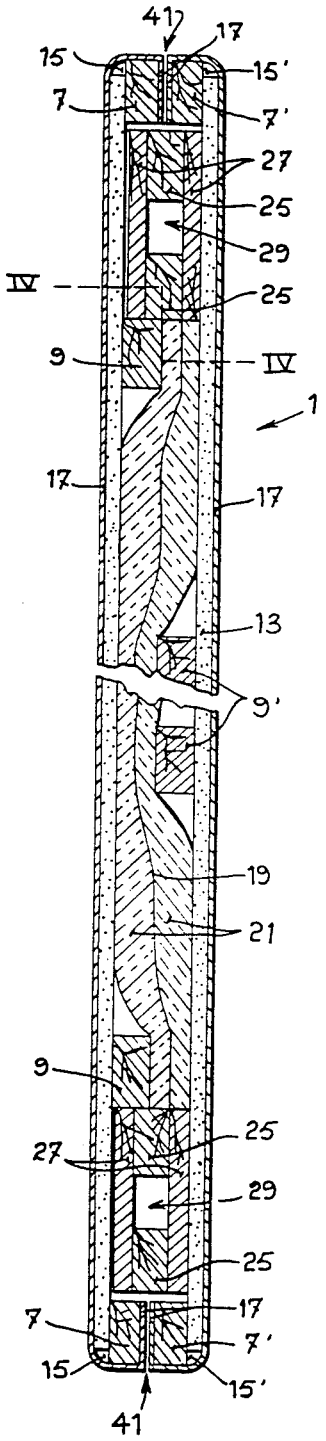
FIG. 3 is a cross-sectional,top plan view of the panel shown in FIG. 2.
Figure 4:
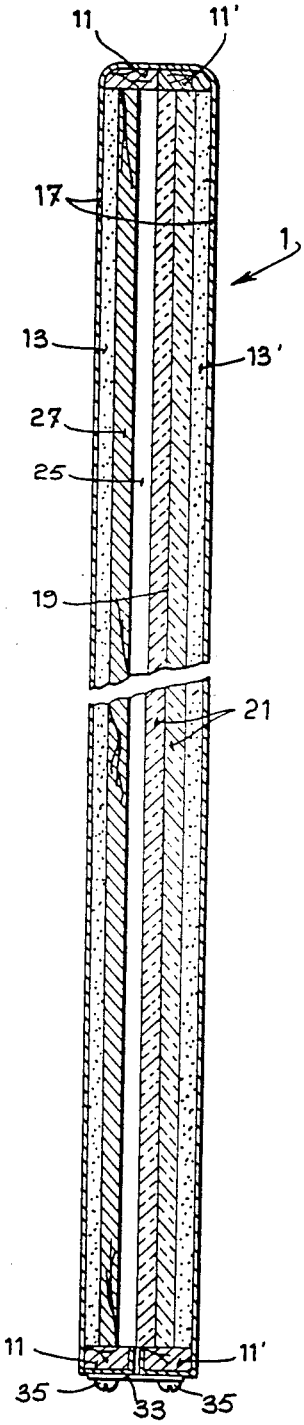
FIG. 4 is a cross-sectional side elevational view of the panels shown in FIGS. 2 and 3.

With particular reference to FIGS. 2 to 4 of the drawings, each panel 1 used in combination with the supports 3 comprises, as basic structural elements, two units 5 and 5' having the same surface area, that are mounted end to end and externally covered with a single piece of cloth 17.

Each unit 5 or 5' comprises two uprights made of wood and whose ends are connected with horizontal planks 11 or 11' that respectively define the upper and lower ends of each unit.

The uprights 7 or 7' can be made, by example, of pieces of pine of $1'' \times 1\frac{3}{4}'' \times 50''$ at the ends of which are fixed horizontal planks of plywood 11 or 11' whose width is larger than the thickness of the uprights. This frame can be reinforced by other internal uprights 9 or 9' regularly spaced apart from each other between the external uprights 7 or 7'.

It should however be noted that the internal uprights 9 of the first unit 5 must be mounted in alternate rows with respect of the internal uprights 9' of the other unit 5' for a reason that will be given hereinafter.

The frame of each unit acts as a support for a rigid board of insulating material 13 or 13' fixed directly to the uprights 7 or 7' and 9 or 9' by means of stamples, large head nails or any other fixing means. In order to securedly maintaining the board of insulating material 13 or 13' laterally between the upper and lower planks 11 or 11' while giving to the panel 1 a nice, rounded, lateral finishing, use is made of edgings 15 or 15' made of pine and having the shape of a quadrant. These edgings can be fixed between the planks of plywood 11 or 11' directly to the external uprights 7 or 7' as shown in FIGS. 2 and 3. Using such edgings 15 or 15' not only gives a nice finishing to the vertical sides of the unit 5 and 5' but also advantageously avoids that the lateral edges of a board of insulating material 13 or 13' be damaged or scratchcd.

The radius of the edging 15 or 15' in the shape of a quadrant is preferably identical to the thickness of the board 13 or 13' that are preferably made of compressed fiber glass of ½" thickness.

One of the most original characteristics of the portable panel 1 previously described lies in the way the units 5 and 5' are mounted to each other by means the single piece of cloth 17 used for externally covering their surface.

For mounting the wall units 5 and 5' together, one single piece of covering cloth 17 of sufficient length is placed onto a flat surface such as a table. The two wall units are then positioned end to end while leaving a short space between them. This short space has to be substantially equal to the total thickness of both wall units although a short space slightly smaller than the total thickness of both units can also be used for improving stretching of the cloth when closing the units one against the other.

The sides of the cloth are then stretched and fixed all around the internal periphery of both units 5 and 5', that is onto the external uprights 7 and 7' and lower planks 11 and 11' of the units 5 and 5'. These uprights and planks being made of wood, the cloth can be easily fixed with stamples or small, large-head nails.

For maintaining the short space between both ends of the units 5 and 5' during stretching and fixation of the cloth, a piece of wood having a length substantially equal to the width of the units and a width equal to the space to be maintained can be inserted between the units 5 and 5'.

Of course, cuts can be made in the corners of the cloth for suitably fixing it all around the internal periphery of the units 5 and 5'.

The way the cloth covers both units 5 and 5' and is fixed to the same is clearly shown on FIGS. 3 and 5 of the drawings and will not be further detailed hereinafter.

As covering cloth 17, use can be made of the wall covering cloth sold under the trademark <<ENDURA>>. This nonwoven cloth made from polyamide is well known for its resistance to wear and its fireproof characteristic. This cloth can be cut in every direction without tearing, which avoids to make a hem. This cloth is also well known for its very high acoustival coefficient that makes it particularly useful in the present case, and for its outstanding aesthetical aspect owing to its texture and the variety of colours available. This cloth is further well known for its fireproof property that makes the panel 1 safe in use in any kind of building.

Once the cloth is fixed, the means for operatively mounting the panel onto support 3 are fixed into at least one of the units 5 or 5'. These means are preferably made of two pairs of uprights 25 made of wood and maintain apart from each other between two planks 27 of plywood whose width is identical to the total of the widths of both uprights 25 plus the width of the space 29 therebetween. The total thickness of the planks 27 and the uprights 25 held together by the planks 27 is advantageously identical to the thickness left between the rigid insulating boards 13 and 13' when the units 5 and 5' are closed one against the other.

For giving a good rigidity to the whole assembly, the uprights 25 can be fixed by their extremeties to the planks 11 or 11'. Preferably, two pairs of uprights 25 defining two passages 29 are mounted in each panel, the uprights 25 being in a position adjacent to both lateral uprights 7 and 7' of the units 5 and 5'.

Actually, the means for operatively installing the panel in a removable manner are essentially constituted by the passages 29 defined between the uprights 25 and planks 11. The passages 29 which extend from the bottom of the panel towards its top allow insertion of one or several rods at the vincinity of the external uprights 7 and 7' of the units 5 and 5'.

For allowing insertion of the support rods in the passages, it is necessary to provide opening 31 suitably located in front of the passages 29 in the lower planks 11 and 11' of the units 5 and 5'.

When the above described mounting means are fixed into at least one of the units either before or after fixation of the covering cloth, the units 5 and 5' are closed one against the other to form the panel 1, by using the cloth 17 that <<connects>> the upper ends of both units 5 and 5' respectively, as a hinge. Units 5 and 5' then form both walls of the panel 1.

One can see that such a closing of the units 5 and 5' one against the other has the advantage of hiding the lateral and lower part of the frame of each unit on which the cloth has been stampled or fixed, thus making it unnecessary to use a decorative mask or any other hiding material as is presently known with the known panels to dissimulate the fixation of the cloth.

This method of closing wall units one against the other has also the advantage of leaving a slot 41 on the vertical edge of each panel 1. The utility of this slot 41 will be described in detail hereinafter.

This method of manufacturing the panel 1 is particularly advantageous in that it substantially simplifies the labour necessary for the covering the units or changing the covering when this is necessary or wanted.

In order to improve both the resistance and the acoustic coefficient of the panel 1, a sound-insulating sheet 19 such as, for example, a sheet of aluminum covered on both sides with a layer of not-compressed material 21 such as, for example, a layer of fiberglass of 1" thickness, can be inserted between the units 5 and 5' before closing them. The sound-insulating sheet 19 and its two covering layers 21 are advantageously located inside the panel between the internal uprights 25 of the mounting means. This sound-insulating sheet and its two covering layers are compressed between the uprights 9 and 9' of each unit when both of them are closed one against the other and they act as a cushioning pad to reinforce the rigid insulating boards 13 and 13' against the external pressure. This arrangement is clearly shown on FIGS. 2 and 3 of the drawings.

The fact that the sound-insulating sheet 19 is covered on both sides with a layer 21 of non-compressed material is of a great advantage as this gives an interesting acoustical coefficient to the panel 1. Indeed, each layer of non-compressed material 21 acts as a muffler and avoids the sound stopped by the sound-insulating sheet 19 in the middle of the panel to come back or even pass through the same.

As soon as the units 5 and 5' are closed one against the other with or without the above described triple sheet of acoustical insulation, the units 5 and 5' are fixed into each other. For this purpose, use is preferably made of a thin plate 33 made of steel, which is fixed with screws 35 directly onto the planks 11 and 11' of the units 5 and 5' respectively. This thin plate 33 preferably has a length substantially identical to the length of the panel 1 and is provided with holes 37 located in front of the openings 31 and passages 29 provided for receiving the support rods used for installing each panel 1 in the building space.

As can be understood upon reading of the above specification, all the materials used for the manufacture of the portable panels 1 are standard materials that are available everywhere at low cost.

Actually, these materials are pieces of wood of standard sizes, compressed fiberglass panels, non-compressed fibreglass layers and plywood planks of standard sizes. This feature and the fact that the manufacture of each panel 1 is very simple, make the panel 1 manufacturable at a very interesting low cost although the so manufactured panel has a nice aesthetical aspect in addition to an excellent sound-insulating efficiency.

As indicated hereinabove, the portable panel 1 whose structure has been described, are mounted onto supports 3 previously placed onto the floor of the building space to be partitioned according to the consumer's requested pattern. As shown in FIG. 1, each support 3 comprises a base 51 vertically extended by a mounting rod 53 that can be inserted into one of the passages 29 of the portable panel 1 through its corresponding hole 37. To firmly hold the rod 53 in vertical position, the base 51 of the support 3 is preferably in the shape of a troncated cone or of a pyramid. This base 51 can be made of an heavy material such as cast iron. The base 51 can also be hollow and provided with an openable lateral door 52 as illustrated in FIG. 5. In this case, the door 52 is removably fixed by means of clips or locking pins to allow insertion of a heavy filler such as sand inside the base 51 of each support 3. This of course can be done directly on the premises.

An horizontal support plate 59 is fixed into the bottom part of the rod 53 for limiting the depth of insertion of the rod inside the passage 29 of each panel 1. The plate 59 can be constituted by a simple rectangular piece of metal welded directly to the rod 53 at a suitable height.

To allow a vertical adjustment of the plate 59 used for limiting the depth of insertion of the panel 1 according to the variation of level of the building floor to be partioned, the rod 53 is preferably provided with a thread portion in its bottom end so that it may be screwed up or down into the base 51. For this purpose, the bottom portion 55 of the rod 53, which is threaded, is engaged with a nut 57 extending outwards of the base 51. Accordingly, the adjustment in height of the rod 53 and therefore of the plate 59 can be made in an easy manner by using a wrench for rotating the external nut 57 in one or other direction.

Another possible embodiment for the support 3 is shown on FIG. 5 of the drawings. According to this other embodiment, the plate 59 used for limiting the depth of insertion of the rod 53 into the panel 1 is replaced by an horizontal sleeve 61 having a C-shaped cross-section. When such a support 3 is used, the upper surface of the sleeve 61 is used for the same purpose as the plate 59. On the other hand, the internal surface of the sleeve 61 acts as a support for a set of modular plynthes 63 each containing a plurality of plugs regularly spaced apart for distributing power and connecting telephones along the panel 1, in an extremely fast manner without requiring specialised labour from the public service companies. Preferably, use will be made of plynthes 63 of the same dimension as the panels 1. Each plynthe 63 will be provided at each end with standardized connecting means (not shown) so that it may be connected to an other plynthe by a not-specialised labour. For example, each plynthe 63 may comprises along its length a plurality of electrical plugs, amphenol connectors 65 and telephone plugs 63.

To supply in a very easily manner the plynthes 63 with power, use can be made of one or more column 67 each provided in its bottom end with standardized connecting means compatible with the connecting means of the plynthe 63. Such a column permits to connect the various plugs and connectors extending along the length of each plynthe 63 to the telephone network or the electric network, through a plurality of supply wires 69 that can be easily passed through the ceiling of the building to be partioned. To avoid short circuits, the column 67 as well as each plynthe 63 may be internally partitioned into one or more compartment for insulating the different supply wires from each other. As can be noted too, the above described arrangement advantageously avoids installing directly onto the floor a plurality of wires always difficult to hide and which generally can only be connected by a specialised labour. Indeed, thanks to the above mentioned arrangement, a single general electrical supply source and a single general telephone connection to the telephone network located in the ceiling of the building space is enough for supplying with electricity and/or telephone any place or space partioned by the portable panels 1, via the column 67 and the plynthes 63.

When the number of portable panels used for partioning the building space is higher than two, it is necessary to connect these panels to each other in a rigid manner to improve stability of the whole assembly. For this purpose, use is made of fixation anchors whose structure and use are extremely simple. These anchors are designed to cooperate in use with the slots 41 extending along the vertical edges of each panel 1.

When the panels 1 have to be horizontally aligned with respect to each other, use is made of anchors in the shape of a small, thin rectangular plate 43. At least one of said plate is inserted into a slot 41 extending along a lateral edge of the panel that must be horizontally extended, in such a manner that half of its surface extends outward of the slot 41. The outwardly extending portion of the plate 43 is then engaged into the slot 41 of the other panel used for extending the first one. As soon as at least one plate 43 is engaged in adjacent slots 41, it laterally holds the panels 1 in a very solid manner.

When a panel has to be connected with two other panels extending perpendicularly thereto, use is made of fixation anchors in the shape of a very thin H-shaped piece 45. Each H-shaped anchor 45 is vertically inserted into the slot 41 of the panel extending perpendicular to the others and then rotated at 90° about its horizontal bar. As a result of this rotation, a T-shaped portion of the anchors 45 extend outwards of the slot 41. The two opposite branches of this T-shaped portion can then be engaged into the slots 41 of the two perpendicular panels for maintaining them aligned with respect to each other perpendicularly to the end of the first panel. Thus is obtained a T-shaped intersection.

It should be noted that the same H-shaped anchor 45 or an other type of anchor 47 in the shape of a T can be used for maintaining two panels prependicularly to each other.

To give a nice aspect to the assembly, use can be made of end elements 71 covered with the same covering cloth as the panel 1 and fixable to the panel by means of T-shaped anchors 47. The purpose of these end elements it is to <<fill>> the recess left at the corner of the intersection of two perpendicular panels.

As can be easily understood, the installation of the panels and their fixation to each other are very simple to carry out even by a not-specialized labour. This feature of course makes the portable panels according to the invention very interesting to use from both a practical and economical point of view.

It is obvious that the scope of the present invention is by no way restricted to the very specific, non-restricting preferred embodiment disclosed hereinabove.

The embodiments of this invention in which an exclusive property or privilege is claimed are defined as follows:

1. A portable panel for partitioning a building space, said panel comprising:

(a) two wall units both having the same surface area, each wall unit comprising a board of rigid insulating material fixed onto one side of a frame comprising a pair of external uprights made of wood, said uprights having ends connected by two horizontal planks, said wall units being mounted end to end onto a single piece of cloth with a small space left therebetween and with said boards in contact with said cloth, said piece of cloth being stretched on and fixed to the uprights and the opposite planks of said two wall units on the other sides of their frames, said wall units being closed one against the other with the piece of cloth acting as a hinge, said closing advantageously dissimulating the fixation of the cloth onto the said wall units and thus avoiding the use of a decorative mask, said two wall units being maintained one against the other in closed position by two small plates extending across and fixed to the opposite planks of the frame of said wall units after said opposite planks have been brought one against the other, said opposite planks of the wall units brought one against the other defining the bottom of the panel, (b) a sound-insulating sheet covered on its both sides with a layer of not-compressed material whose function is to improve the acoustic factor of the whole panel by muffling the sound stopped by the insulating sheet, said insulating sheet and its two covering layers being located inside the panel between the two wall units and (c) means integral with said wall units for operatively installing the panel in the building space in a removable manner, said installation means comprising at least two passages provided in said frames for receiving a support rod, said passages extending from said opposite planks brought one against the other toward the top of the panel, each of said passage being defined by two other uprights made of wood and fixed parallel to the uprights of the frame of at least one of said units between two vertical planks whose surfaces are parallel to the surfaces of the wall units;

wherein the frame of each unit further comprises a plurality of internal uprights spaced apart from each other between the external uprights, said internal uprights of both of said units being mounted in alternate rows to pinch the insulation sheet and its two covering layers therebetween.

2. A portable panel as claimed in claim 1, comprising two different passages each for receiving a support rod, said passages being adjacent to the external uprights of both wall units.

3. A portable panel as claimed in claim 2, wherein:

the boards of rigid insulating material are made of compressed fiberglass;

the sound insulating sheet is made of aluminum;

the two layers covering the sound insulating sheet are made of not-compressed fiberglass;

the small plates fixing the end of both units together are made of steel; and the uprights and planks defining the passages for receiving at least one support rod extends over all the height of the panel.

* * * * *